United States Patent [19]

Rohde

[11] 4,352,247

[45] Oct. 5, 1982

[54] SQUARE LEVEL FOR DRAWING ANGLES AND PARALLELS

[76] Inventor: Norbert-Josef Rohde, Am Kleekamp 23, 5024 Pulheim, Fed. Rep. of Germany

[21] Appl. No.: 143,443

[22] Filed: Apr. 24, 1980

[30] Foreign Application Priority Data

May 7, 1979 [DE] Fed. Rep. of Germany ..... 2918321

[51] Int. Cl.[3] ..... B43L 7/00

[52] U.S. Cl. ..... 33/428; 33/464; 33/191

[58] Field of Search ..... 33/428, 427, 452, 454, 33/464, 191

[56] References Cited

U.S. PATENT DOCUMENTS 535,223 3/1895 Rowell ..... 33/428
1,893,973 1/1933 Yavicoli ..... 33/464
2,348,878 5/1944 Behen .

FOREIGN PATENT DOCUMENTS 195050 2/1908 Fed. Rep. of Germany .
468102 11/1928 Fed. Rep. of Germany .
633637 7/1936 Fed. Rep. of Germany ..... 33/464
232517 10/1969 U.S.S.R. ..... 33/191

*Primary Examiner*—Harry N. Haroian
*Attorney, Agent, or Firm*—Jones & Askew

[57] ABSTRACT

A square for plotting angles, parallels, and polygonal shapes on the circular surface of a cylindrical body. The square includes a pair of contact arms forming a right angle, and a center arm forming a bisector of the right angle. A protractor frame is slidably attached to the center arm, and a pointer is attached to the arc-shaped portion of the protractor. The square includes a separate attached straightedge parallel to the center arm, and movable in variable spaced relation thereto.

8 Claims, 3 Drawing Figures

SQUARE LEVEL FOR DRAWING ANGLES AND PARALLELS

Figure 1:
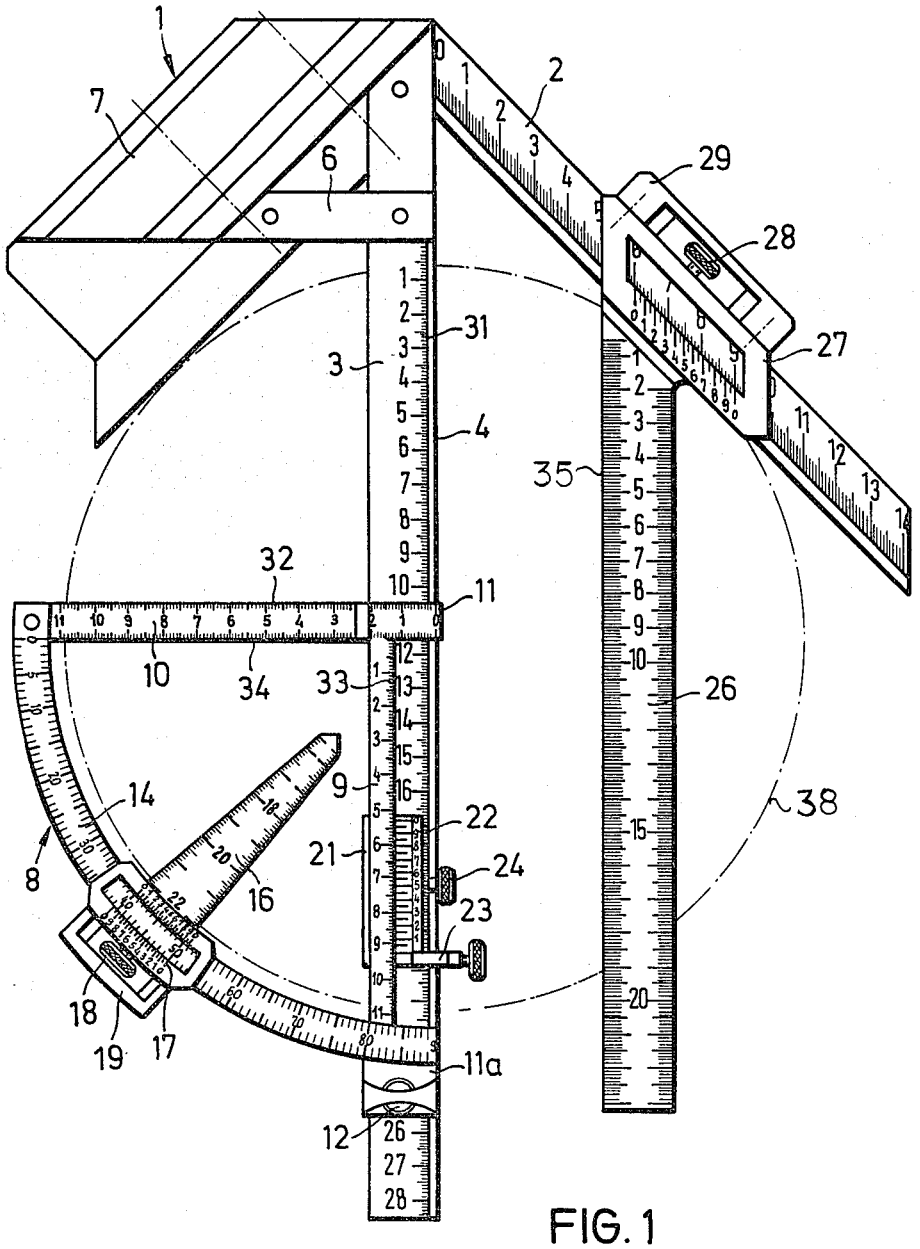

The present invention deals with a square for drawing angles and parallels consisting of two contact arms which are joined at one end and which subtend a right angle, as well as of a center arm attached to the intersection area of the two arms and whose longitudinal edge forms the bisector of the right angle.

There already exists a square called a center square. The contact arms of this center square are put flush against the circumference of a circular surface in such a way that the center of the circular surface can be marked with the center arm. However, even with this known center square it is not possible to plot any desired angles, or to mark or draw any regular or irregular polygons on the surface of a cylindrical body. To draw such shapes on the circular surface of a cylindrical body it has been necessary to use a protractor, a set of parallel rulers, and a marking plate, all in conjunction with each other, which is relatively difficult and time-consuming. Furthermore, these three separate instruments are difficult to use and to carry. In addition, they are expensive to manufacture.

The purpose of the present invention is the improvement of a square according to the present state of the art which permits an easy and rapid plotting of any angle and any polygon on the circular surface of a cylindrical body. In addition, the square according to the invention should be characterized by a relatively lightweight and low manufacturing costs.

According to the invention this is achieved by attaching a protractor frame at a right angle to the center arm by means of a frame piece which slides longitudinally. The frame piece is equipped with a sliding jig plate whose abutment surface is perpendicular to the longitudinal edge of the center arm which bisects the right angle. An arc-shaped piece of at least 90° connects the ends of the protractor frame pieces. It is advantageous for both frame pieces to be of equal length and joined at both free ends by the arc-shaped piece which describes a 90° arc. Furthermore, it is advantageous according to this invention to attach a sliding pointer perpendicularly to the 90° arc piece. By means of the jig plate the radius of the workpiece which is to be marked can be set on the arm of the protractor frame which is parallel to the center arm. Once the jig plate is properly set, the protractor frame can be moved until the abutment surface is flush with the workpiece. After this setting, the arm pointer points exactly to the center of the workpiece which can then be marked without difficulty. With the help of the graduated scale on the 90° arc piece and the two vernier scales on the arm pointer any angle can be set on the 90° arc piece of the protractor frame and marked on the workpiece. The inside edge of the protractor frame piece which is perpendicular to the center arm forms a second diagonal on the workpiece situated at a 90° angle to the diagonal formed by the center arm. It is therefore possible to add the already set angle by turning the entire square, and any angle partition and any polygon can be marked on the workpiece. The parallel straightedge provided according to the invention is used to mark squares or rectangles, or to join points of intersection for regular or irregular polygons, or to mark chords, etc.

The square for centering and drawing angles according to the invention is an instrument which from the point of view of design and above all weight is easy to use in any circumstance, i.e., it can be set up and used quickly in any place. This is a great advantage if the workpiece cannot be transported, either due to its weight or because it is permanently attached to other construction elements.

Figure 2:
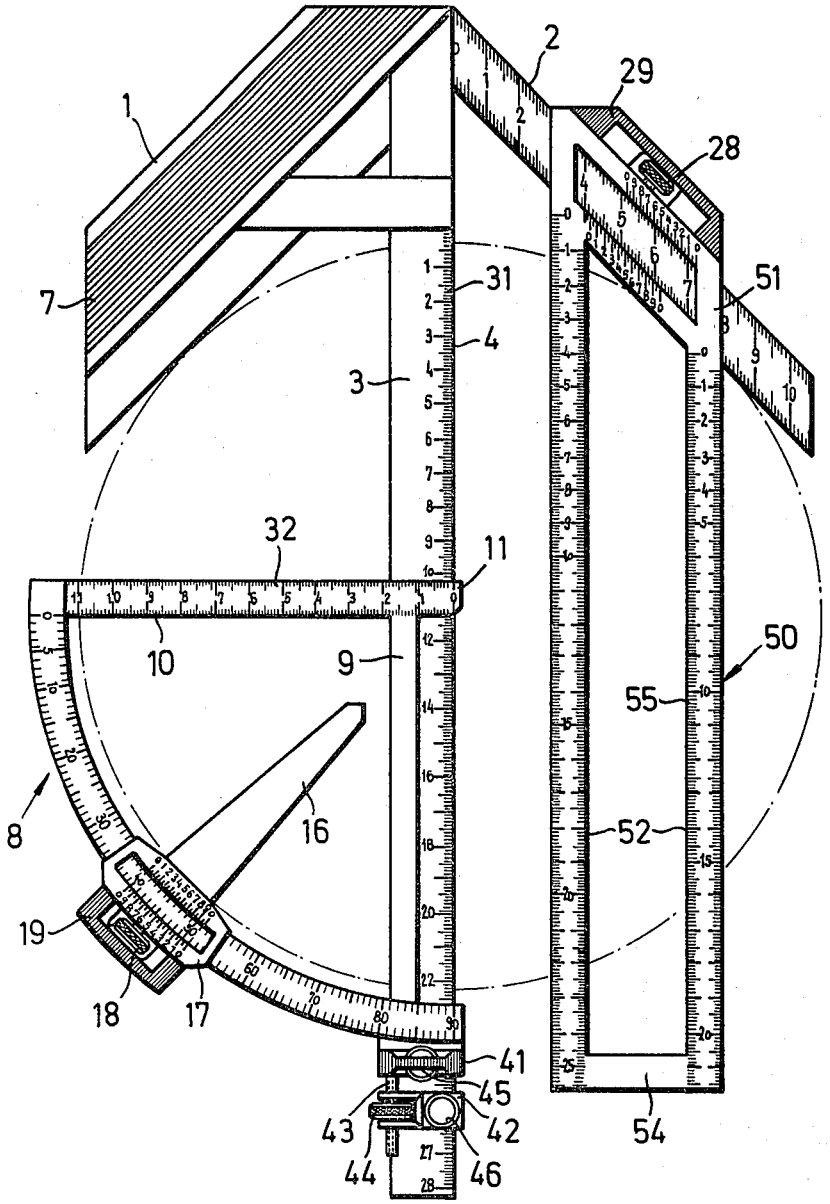
Figure 3:
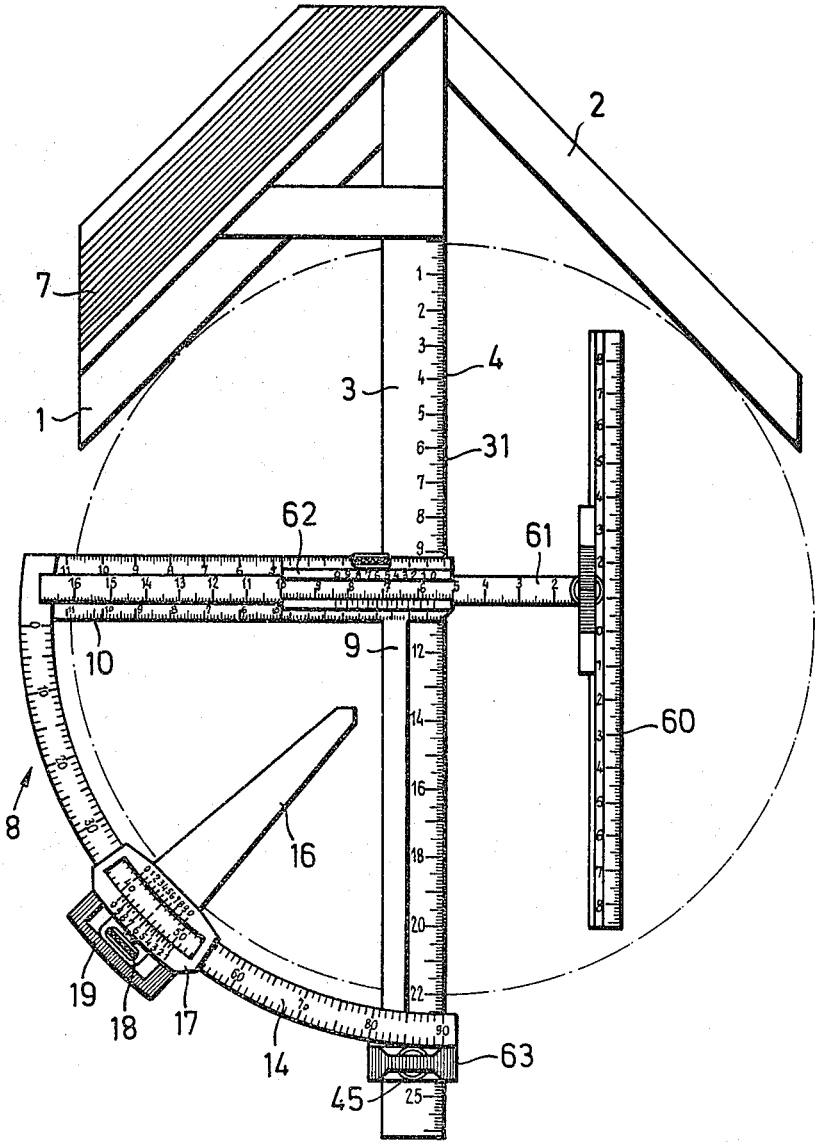

The appended diagrams represent examples of execution which further elucidate the invention:

FIGS. 1 to 3 are top views of forms of execution of the square for centering and drawing angles according to this invention.

The square for centering and drawing angles according to the invention consists of two contact arms 1, 2 which are joined at one end and form a right angle. At the point of intersection of the contact arms 1, 2 a center arm 3 is attached; one of its longitudinal edges 4 forms the bisector of the right angle subtended by the contact arms. The entire square for centering and drawing angles is reinforced by a crossbar 6 which is connected to the contact arm 1 and the center arm 3. A handle 7 with which the square for centering and drawing angles can be manipulated is attached to the outside of the contact arm. The handle 7 can consist of synthetic material, for example, and it can be attached by screws, for example, to the outside of the contact arm. As can be seen from FIG. 1 a 90° protractor frame 8 is attached to the center arm 3 by means of a frame piece 9 which slides longitudinally. To guide the frame piece 9 on the center arm 3 the frame piece 9 has a crosspiece 11 at both ends; the clamp ends of the crosspieces straddle the sides of the center arm, fitting in preferably dovetail grooves in the center arm. At the end of the frame piece 9 is a handle part 11*a* with a clamping screw 12. With this part the entire protractor frame can be secured in the desired position on the center arm 3. The free ends of the frame pieces 9, 10 of the protractor frame 8 are connected by an arc-shaped piece 14 which in the example given has the shape of a 90° arc. A pointer 16 is attached to the arc-shaped piece 14 by means of a cursor. With a clamping screw 18 the pointer can be secured firmly in any position on the arc-shaped piece 14. In order to make it easier to slide the cursor 17, a handle 19, made preferably of synthetic material, is mounted to its outside. A sliding jig plate 21 is attached to the frame piece 9 of the protractor frame 8, which is parallel to the center arm 3. This jig plate 21 consists of a cursor 22 and an abutment 23 which is perpendicular to the cursor. The abutment 23 is preferably attached to the cursor 22 in such a manner that it can be removed. The cursor 22 is guided by longitudinal guide grooves on frame piece 9. These parts make it possible for the entire protractor frame to be secured by means of the clamping screw 24 or to be moved longitudinally, together with the bracket, along the center arm 3.

As can be seen from FIG. 1 the square for centering and drawing angles according to this invention also include a parallel straightedge 26. This parallel straightedge is attached at one end to the contact arm 2 by means of a sliding cursor 27. The guidance of the cursor 27 on the contact arm 2 is accomplished in a known way with T-shaped guide grooves in which the tongues on the side of the cursor 27 are inserted. With a clamping screw 28 the cursor 27 can be secured to the contact arm 2. By moving the cursor the parallel straightedge 26 is moved in parallel motion with respect to the center arm 3. As shown in the example it is advantageous for the contact arm 2 which serves to guide the parallel edge to be longer than the contact arm 1. A handle 29, preferably made of synthetic material is formed on the cursor to allow for an easier manipulation of the cursor. Furthermore as can be seen in FIG. 1, different parts of the square for centering and drawing angles according to the invention are marked with different scales. A continuous scale 31 is marked on the center arm. This scale 31 is graduated in millimeters. The frame pieces 9, 10 also have scales 32, 33 which are advantageously graduated in millimeters. Scales 32, 33 on the frame pieces are arranged in such a manner that the longitudinal edge 4 of the center arm coincides with the beginning of scale 32, and the inside edge of the frame piece 10 coincides with the beginning of scale 33. The parallel straightedge 26 is also preferably marked with a scale 35 graduated in millimeters. In order to read or set the parallel movement of the parallel straightedge 26 with respect to the center arm 3 with accuracy on the contact arm 2, the contact arm 2 is also marked with a scale. If the cursor 27 is moved by 10 mm according to the scale, the cursor 27 actually covers a distance of 14.14 mm on the contact arm 2 while the distance between the center arm 3 and the parallel edge 26 changes by only 10 mm.

The square for centering and drawing angles shown in FIG. 1 operates as follows: first the radius of the workpiece 38 (dashed line in drawing) is set with the jig piece 21 on the scale 33 of the frame piece 9 and the jig plate 21 is firmly secured with the clamping screw 24. Then the entire protractor frame 8 is moved until the abutment 23 of the jig plate 21 meets the workpiece. The protractor frame is then also firmly secured with a clamping screw 12. In this manner the square for centering and drawing angles according to the invention is fitted around the workpiece 38, but it still can be rotated without difficulty around the workpiece by 360° or more. After such adjustments are made the pointer 16 is set and points exactly to the center of the workpiece 38, which can then be marked easily. With the help of the graduation in degrees on the scale of the arc-shaped protractor piece 14 any angle can be set and marked with a scribing tool on the workpiece. Since the edge 34 of the frame piece 10 forms the second diagonal on the workpiece at a 90° angle with respect to the longitudinal edge 4, any angle set on the protractor with the arm pointer can be added as many times as desired by rotating the entire square. Any angular partition and any polygon can thus be marked on the workpiece. The parallel straightedge 26 serves to mark squares for rectangles, or to join the vertices of regular or irregular polygons, or to mark chords or secants or tangents, etc. For this operation the desired separation between the parallel straightedge and the center arm is set on the contact arm 2 with the cursor 27. When the parallel edge is secured firmly with the clamping screw, the desired line can be marked on the workpiece, for example with the help of a scribing tool.

FIGS. 2 and 3 represent examples of execution of the square for centering and drawing angles. Any parts which correspond to the parts in the execution example according to FIG. 1 are identified with the same reference numbers.

The execution example represented in FIG. 2 differs from that in FIG. 1 in that the adjustment of the protractor frame by means of the handle part 11*a* is executed differently, and so is the parallel straightedge. An adjustment part 42 which acts via an adjustment spindle 43 on the handle part 41 of the protractor frame 8 is provided for fine adjustment of the position of protractor frame 8. By means of an adjustment wheel 44 the distance between parts 41 and 42 can be set on the spindle 43. By means of clamping screws 45, 46 both parts can be firmly secured. The other difference involves the design of the parallel straightedge 50. In this example it consists of two parallel rules 52 which are attached to the cursor 51. The free ends of the rules 52 are connected by a crosspiece 54 for structural stability. The advantage of this execution form is that the fixed distance between the two rules 52 permits the simultaneous drawing of several parallel lines. It is also advantageous for the rules 52 to be marked with a scale in millimeters 55.

FIG. 3 is another execution form of the square for centering and drawing angles according to the invention. Parts which correspond to those of FIGS. 1 and 2 are marked with the same reference numbers. The main difference between this execution form and the one according to FIG. 1 consists of a different guidance system for the parallel straightedge 60. This parallel straightedge 60 is attached to a perpendicular arm 61 which slides on the frame piece 10 of the protractor frame 8 perpendicular to the center arm 3. A cursor 62 is attached to the frame piece 10. The perpendicular arm 61 slides in dovetail grooves on the cursor 62. It is advantageous to graduate the perpendicular arm 61 with a scale to permit an easy setting of the distance to the center arm 3. The design of the handle part 63 corresponds to the form of the handle 11*a* according to FIG. 1.

FIGS. 2 and 3 do not show a bracket piece 21 of the type shown in FIG. 1. However, it is advantageous to provide such a bracket in the executions represented in FIGS. 2 and 3.

I claim:

1. A square for drawing angles and parallels, comprising in combination:

two contact arms which are joined at one end and which subtend a right angle;

a center arm attached to the intersection area of the two contact arms and having a longitudinal edge forming the bisector of said right angle;

a protractor frame attached at a right angle to said center arm, said protractor frame including a first frame piece which slides longitudinally along said center arm and a second frame piece perpendicular to the center arm;

a jig plate attached to said first frame piece and having an abutment perpendicular to the longitudinal edge of the center arm; and said two frame pieces being connected by an arc-shaped piece which subtends at least a 90° arc.

2. A square according to claim 1, further comprising a sliding pointer attached perpendicularly to the arc-shaped piece.

3. A square according to claim 1, further comprising at least one sliding parallel straightedge parallel to the center arm and attached to one of said contact arms opposite to the protractor frame at a selectably variable distance from and parallel to the center arm.

4. A square according to claim 3, characterized by the fact that one end of the parallel straightedge is attached by a sliding cursor to said one contact arm.

5. A square according to claim 1, further comprising a parallel straightedge attached to a perpendicular arm slidably mounted on said second frame piece of the protractor frame for movement perpendicular to the center arm, so that said parallel straightedge is selectably movable in parallel relation to said center arm.

6. A square according to claim 1, characterized by the fact that the abutment of the jig plate is removably attached thereto.

7. A square according to either of claims 3 or 5, characterized by the fact that the jig plate, the pointer, and the parallel straightedge are selectably secured in their respective positions by means of clamping members.

8. A square according to claim 1, wherein said protractor frame is equipped with a handle having clamping means which can be firmly secured to said center arm, so that the position of said protractor frame relative to the right angle subtended by said contact arms is adjustably fixed.

* * * * *